US006593683B1

(12) United States Patent
Dzbanovsky et al.

(10) Patent No.: US 6,593,683 B1
(45) Date of Patent: Jul. 15, 2003

(54) COLD CATHODE AND METHODS FOR PRODUCING THE SAME

(75) Inventors: Nikolai Nikolaevich Dzbanovsky, Leninsky (RU); Andrei Alexandrovich Pilevsky, Moscow (RU); Nikolai Vladislavovich Suetin, Elektrostal (RU); Alexandr Tursunovich Rakhimov, Moscow (RU); Mikhail Arkadievich Timofeev, Moscow (RU)

(73) Assignee: Obschestvo s ogranichennoy otvetstvennostyu "Vysokie Tekhnologii", Moscow (RU)

( * ) Notice: Subject to any disclaimer, the term of this patent is extended or adjusted under 35 U.S.C. 154(b) by 0 days.

(21) Appl. No.: 09/720,414

(22) PCT Filed: Jun. 23, 1998

(86) PCT No.: PCT/RU99/00200

§ 371 (c)(1),
(2), (4) Date: Mar. 7, 2001

(87) PCT Pub. No.: WO98/59355

PCT Pub. Date: Dec. 30, 1998

(30) Foreign Application Priority Data

Jun. 24, 1997 (RU) ..... 97109616

(51) Int. Cl.[7] ..... H01J 1/02

(52) U.S. Cl. ..... 313/310; 313/495; 313/309; 313/336; 313/351

(58) Field of Search ..... 313/309, 310, 313/336, 351, 495

(56) References Cited

U.S. PATENT DOCUMENTS 5,463,271 A 10/1995 Geis et al.

FOREIGN PATENT DOCUMENTS

| | | |
|---|---|---|
| DE | 2628584 | 7/1980 |
| EP | 0159199 | 10/1985 |
| EP | 0528391 | 2/1993 |
| RU | 997128 | 2/1983 |
| RU | 2004028 | 11/1993 |
| RU | 2094891 | 10/1997 |

*Primary Examiner*—Vip Patel
(74) *Attorney, Agent, or Firm*—Collard & Roe, P.C.

(57) ABSTRACT

The present invention relates to the production of highly efficient films for field-effect electron emitters, wherein said films may be used in the production of flat displays, in electronic microscopes, in microwave electronics, in light sources as well as in various other applications. This invention more precisely relates to a cold cathode that comprises a substrate having a carbon film applied thereto. The carbon film has an irregular structure consisting of carbon micro-ridges and/or micro-threads which are perpendicular to the surface of the substrate, have a size ranging typically from 0.01 to 1 microns and a distribution density of between 0.1 and 10 $\mu m^2$. This invention also relates to method for producing a cold electrode, wherein said method comprises generating a DC current discharge in a mixture comprising hydrogen and a carbon-containing additive, and further depositing the carbon phase on the substrate located at the anode. This method is characterized in that the discharge is generated at a current density of between 0.15 and 0.5 $A/cm^2$. The deposition process is carried out in a mixture containing hydrogen and vapors of ethylic alcohol or methane, under an overall pressure of between 50 and 300 Torrs and at a substrate temperature of between 600 and 900° C. The concentration of ethylic alcohol vapors ranges from 5 to 10% while that of methane vapors ranges from 15 to 30%. This invention also relates to another method for producing a cold cathode, wherein said method comprises generating a microwave discharge at an absorbed power of between 100 and 1000 W. This discharge is generated in a mixture containing gaseous carbon oxide as well as methane in an 0.8–1.2 concentration and under a pressure of between 10 and 200 Torrs, the carbon phase being further deposited on the substrate. This method is characterized in that the deposition process is carried out at a temperature on the substrate surface that ranges from 500 to 700° C.

4 Claims, 5 Drawing Sheets

COLD CATHODE AND METHODS FOR PRODUCING THE SAME

CROSS REFERENCE TO RELATED APPLICATIONS

Applicant claims priority under 35 U.S C. § 119 of Russian Application No. 97109616 filed Jun. 24, 1997. Applicant claims priority under 35 U.S.C. §120 of PCT/RU98/00200 filed Jun. 23, 1998. The international application under PCT article 21(2) was not published in English.

FIELD OF USE

Invention relates to fabrication of highly effective films for field emitters of electrons which can be used to produce flat panel displays, electron microscopes, microwave electronics, light sources and for some other applications.

PRIOR ART

Cold emission film cathode is known which comprises a substrate coated with a diamond film [Application of Diamond Films and Related Materials: Third International Conference, 1995, NIST Special Publication 885, Edited by A. Feldman et al., p. 37, p.61]. By the present date all attempts to create a highly effective emitter of electrons on a basis of polycrystalline diamond film can't be considered to be successful, in particular, because of a low density of emission sites.

The most relevant to the present invention is a cold emission film cathode comprising a substrate coated with a carbon film [<<Diamond based field emission flat panel displays>>Solid State Techn., 1995, May, p.71]. The film deposited on the substrate is a film of amorphous carbon.

A method is known to produce a cold emission film cathode by a method of laser sputtering [<<Diamond based field emission flat panel displays>>Solid State Tech., 1995, May, p. 71], which comprises the deposition on a cold substrate of carbon evaporated from a graphite target by a powerful laser radiation. Shortcoming inherent to this method is its complexity, high cost, limited scaling up capability , and also the low density of emission sites ( about 1000 per sq.cm in the electrical field of 20 V/micron) what is apparently insufficient for creation of a full color display with 256 grades of brightness.

A method is known to produce a cold emission film cathode by a method of plasma chemical vapor deposition comprising a DC glow discharge in an electrode gap between cathode and anode in a flow of hydrogen, heating a substrate up to the deposition temperature, injection of a carbon containing gas into flow and deposition of a film from a mixture of hydrogen and carbon containing gas, removing of excessive graphite phase by a discharge in hydrogen flow [A. T. Rakhimov, B. V. Seleznev, N. V. Suetin et al. Applications of Diamond Films and Related Materials: Third International Conf., Gaithersburg, Md., USA, 1995, NISTIR 5692, Supplement NIST Special Publication 885, p.lIs]. Thus the nano-diamond film cathodes are produced. But the diamond films produced by this method grow very slowly and often do not possess emissive properties sufficient for creation of a full color display.

A method is known to produce a diamond cathode [U.S. Pat. No. 4,816,286, 1989] comprising a microwave discharge with input power of 100–1000 W in a mixture of carbon dioxide and methane with the ratio of 0.8–1.2 at pressure of 20–100 Torr and deposition of the carbon phase on a substrate. But this method is very costly and films produced by this method possess rather non uniform emissive performances.

SUMMARY OF THE INVENTION

The technical goal of this invention is obtaining of a cold emission film cathode possessing high electron emissive performances which can be used as a field emitter of electrons for production of flat panel displays, electron microscopes, microwave electronics, light sources and for some other applications, This task can be solved due to that the cold emission film cathode comprising a substrate coated with a carbon film deposited on it is made in the form of a structure of irregularly located carbon micro— and nano-ridges and/or micro— and nano-threads (tips) normally oriented to the substrate surface and having typical size of 0.01–1 micron and distribution density of 0.1–10 $\mu m^{-2}$. The cathode can be produced by two methods.

Using the first method the cold emission film cathode is produced in a DC glow discharge in a mixture of hydrogen and carbon containing gas via deposition of a carbon film on a substrate placed on an anode. The DC glow discharge is ignited at a current density of 0.15–0.5 A/sq.cm, and deposition is carried out from a mixture of hydrogen and ethyl alcohol vapor or methane at total pressure of 50–300 Torr and substrate temperature of 600–900 C., and concentration of ethyl alcohol shall be 10–15% and concentration of methane shall be 15–30%.

Using the second method the cold emission film cathode is produced in a microwave discharge with input power of 5–50 W/cub.cm in a mixture of carbon dioxide and methane with the ratio of 0.8–1.2 at pressure of 20–100 Torr and deposition of the carbon phase on a substrate is carried out at the substrate temperature of 500–700 C.

BRIEF DESCRIPTION OF DRAWING

The present invention can be better understood from the accompanying drawings where.

Figure 1A:
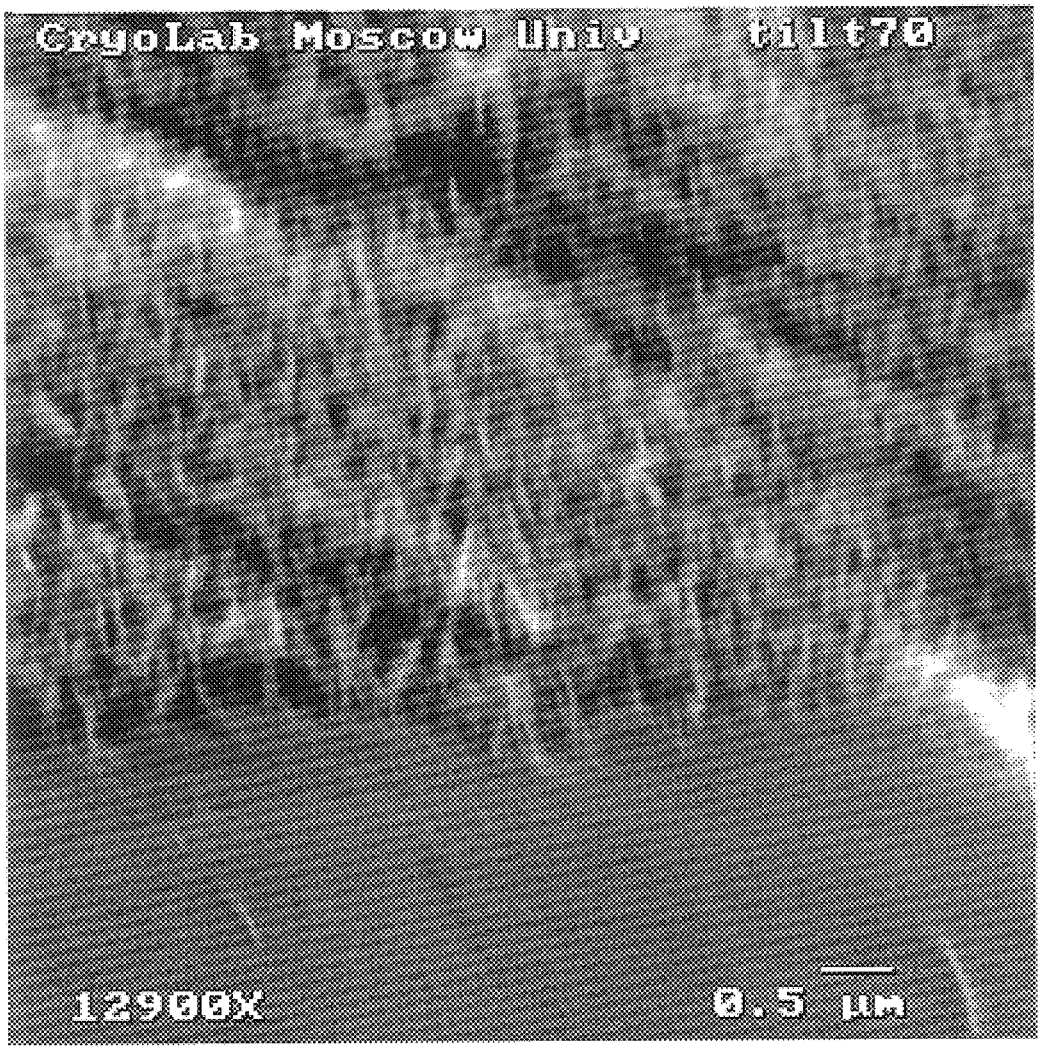
FIGS. 1*a*, 1*b* shows the typical images of high emitting films made by scanning electron microscope.
Figure 1B:
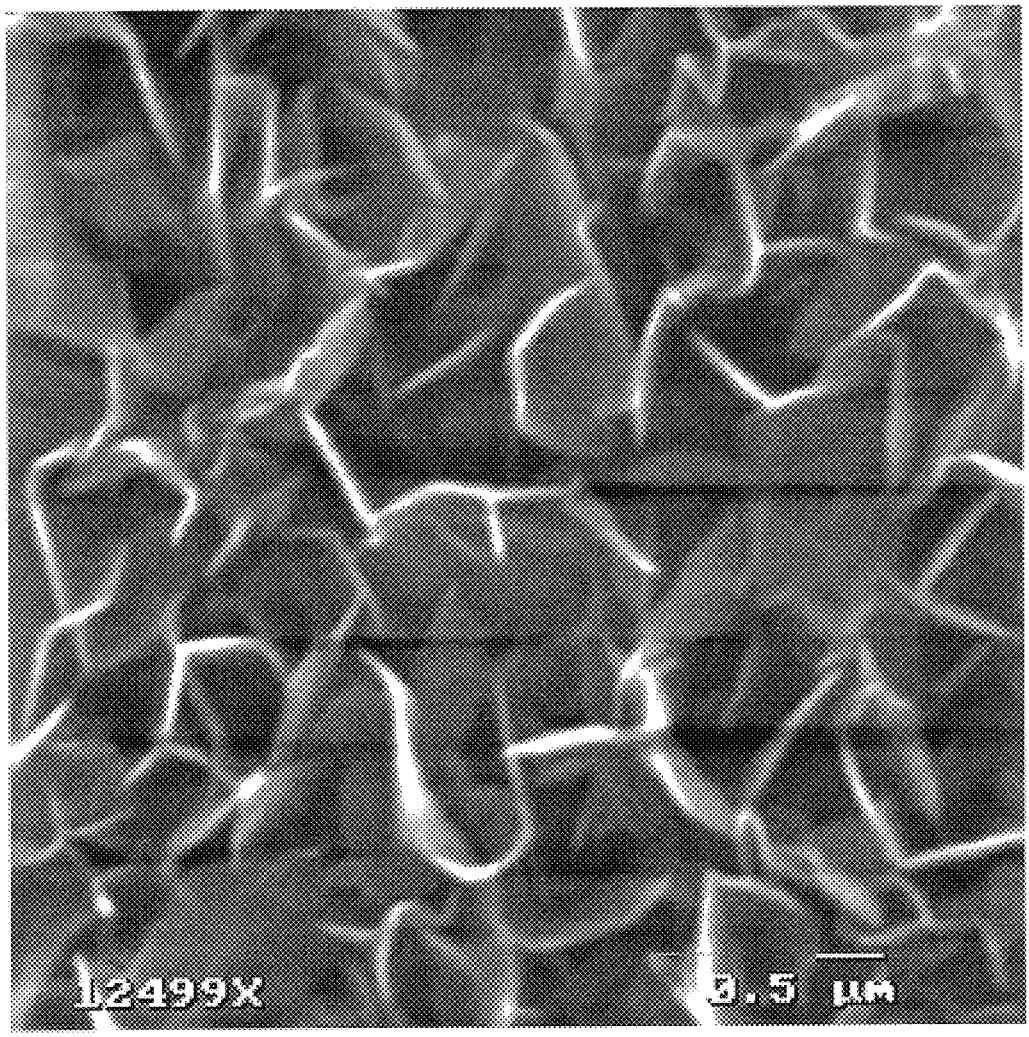

As it can be seen from the FIGS. 1*a*, 1*b* the films can be either the thread-like (a) or strip-like (b) structures which are oriented normally to the surface.

Figure 2:
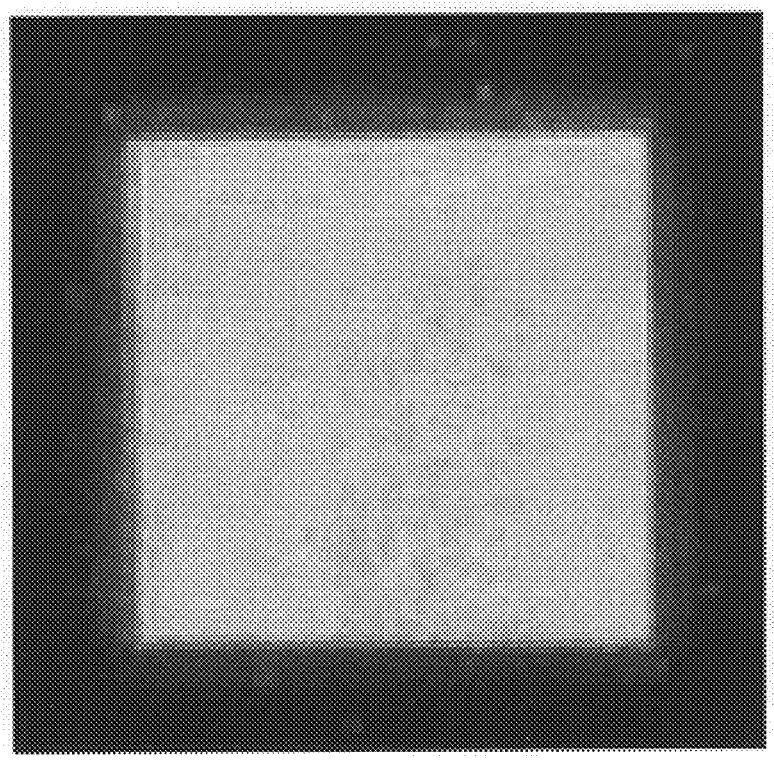
FIG. 2 shows a distribution of emission current from one of such films.

The FIG. 2 shows the distribution of a phosphor luminescence which is proportional to the current density of the exciting electron beam. Size of the sample is 25 mm×25 mm. It can be seen that the distribution of emission current is quite uniform. Emission sites density was about 300000 per sq.cm what is sufficient to create an emission display.

Figure 3:
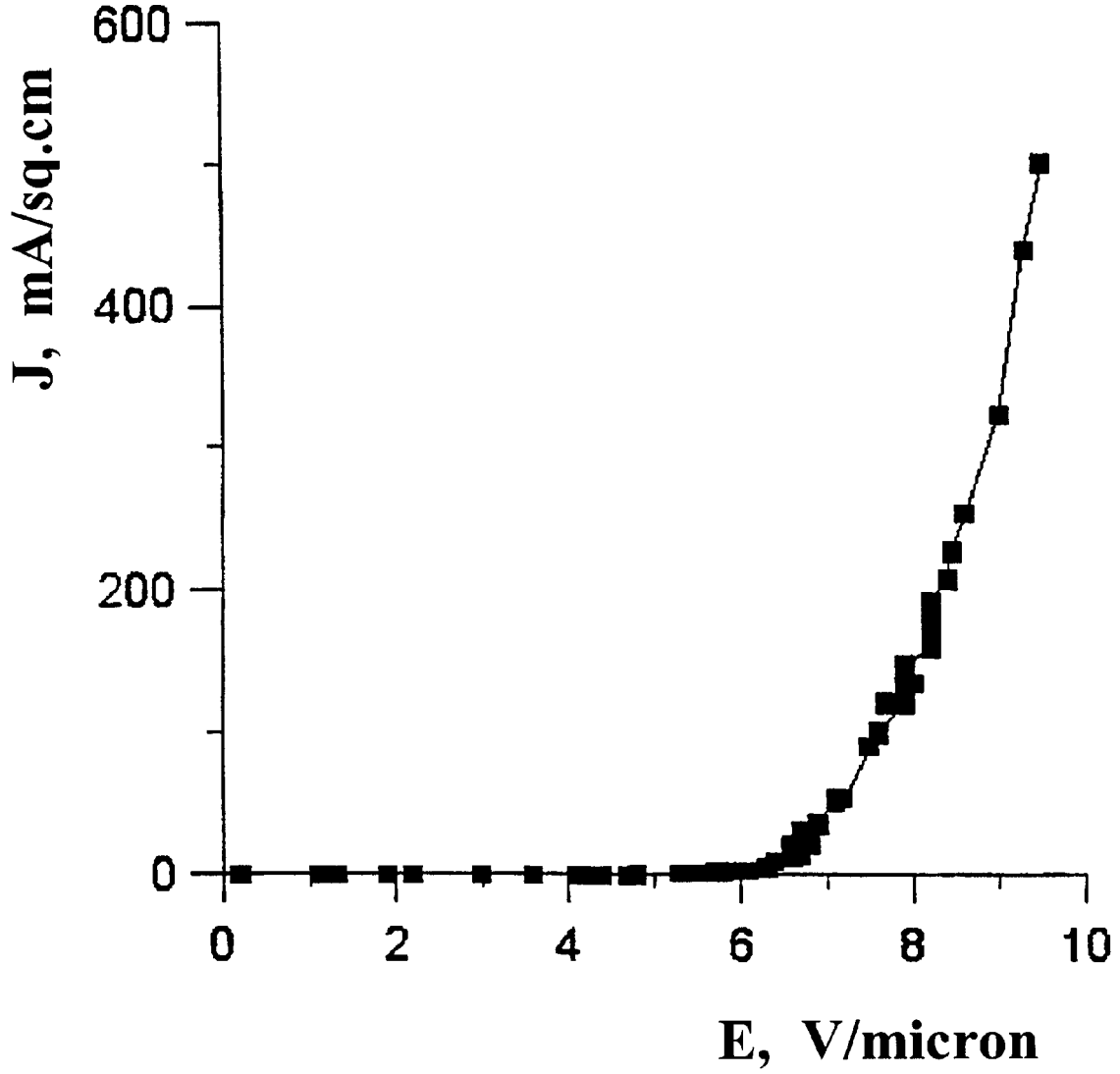
FIG. 3 shows a dependence of emission current on strength of electrical field.
Figure 4:
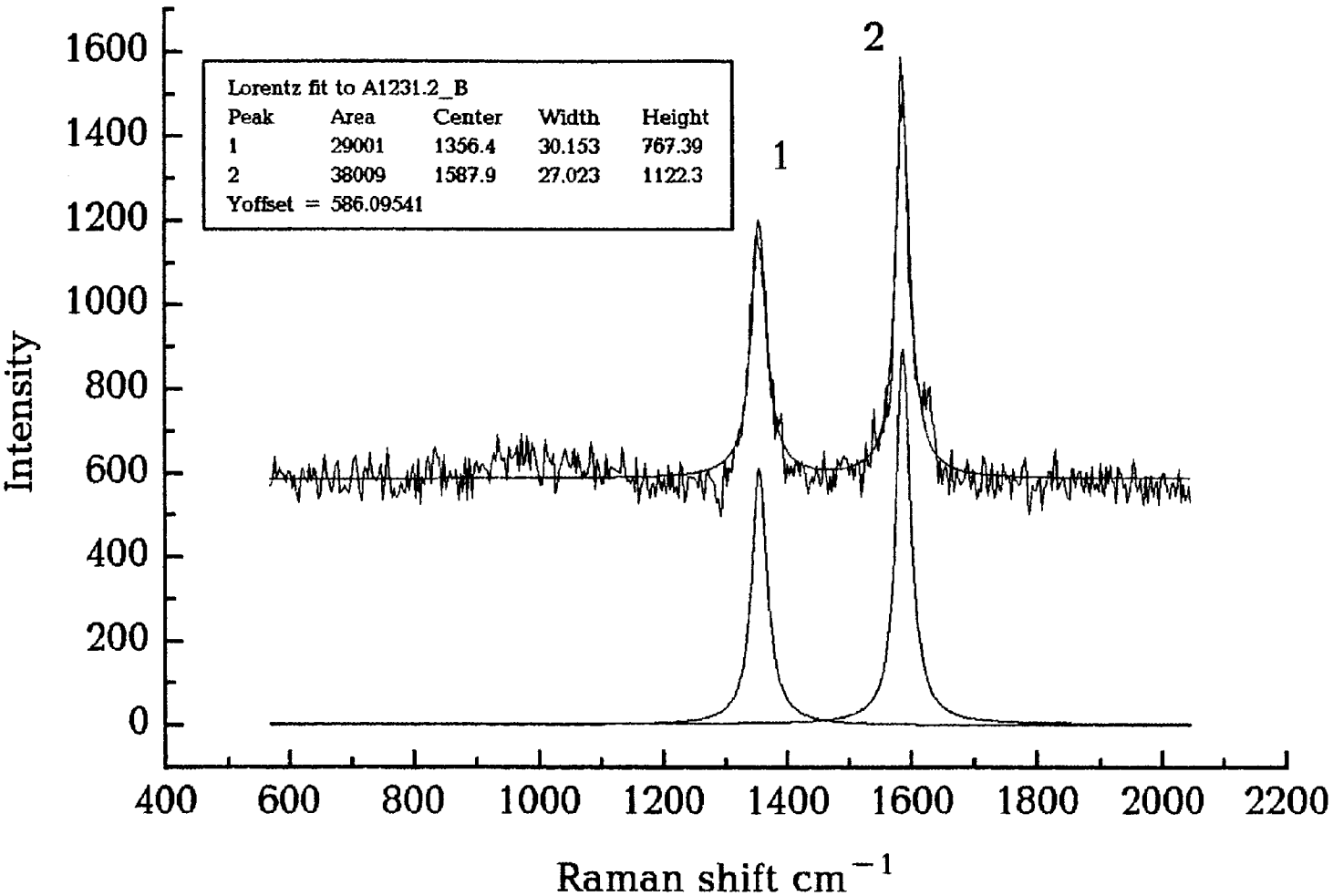
FIG. 4 shows typical Raman spectrum of the produced films.

The volt-ampere characteristics of emission current are shown in the FIG. 3. It illustrates the dependence of emission current on strength of electrical field. It can be seen that the emission threshold is quite low, The deposited substance was investigated using scanning electron and tunneling microscopy, X-ray diffractometry and Raman spectroscopy, The FIG. 4 represents the typical Raman spectrum.

The investigations show that the deposited substance is a micrographite and consists of the thread-like or strip-like structures which are irregularly located along over the substrate surface at a distribution density of about 1 per sq. micron. This substance is highly electrostatically strong. Thus the film withstands the electrical filed of up to 30 V/micron.

PREFERRED EMBODIMENTS OF THE METHOD

The first method comprises a DC glow discharge in a mixture of hydrogen and carbon containing gas and deposition of a carbon film on a substrate placed on an anode. The DC glow discharge is ignited at a current density of 0.15–0.5 A/sq.cm, and deposition is carried out from a mixture of hydrogen and ethyl alcohol vapor or methane at total pressure of 50–300 Torr and substrate temperature of 600–900 C., and concentration of ethyl alcohol shall be 5–10% and concentration of methane shall be 15–30%.

The gas mixture can be dissolved with the inert gas, for example with argon, up to 75% at maintaining the total pressure unchanged.

Method to produce a cold emission film cathode in a DC discharge is carried out in a chamber equipped with a gas supply systems providing feeding and control over the gas mixture of hydrogen and carbon containing admixtures. Discharge is ignited between two electrodes connected to an electrical power supply system. Anode is used as a substrate holder, a silicon plate of 400 microns thickness can be used as a substrate, If concentration of ethyl alcohol vapor is less than 5% or methane concentration is less than 15% and pressure is less than 50 Torr, then a nucleation is slowed down leading to a higher non uniformity of the emission characteristics. Also a texture of films changes. If concentration of ethyl alcohol vapor is more than 10% or methane concentration is more than 30% and pressure is more than 300 Torr, then discharge is subjected to instability, If current density exceeds 0.5 A/sq.cm the gas and substrates are subjected to an overheating resulting in a worsening of a film emission performances.

If current density is less than 0.15 A/sq.cm the required activation of gas media is not provided.

Substrate temperature less than 600 C. or more than 1100 C. results in a pronounced change of the film texture and loss of emissive properties.

Substrate temperature which was determined by the discharge power, special heater and cooling system was monitored with an optical pyrometer and was measured accounting the corresponding corrections to be ranged as 600–1000 C. Current density was 0.15–0.5 A/sq.cm. At such conditions a carbon film growth was provided up to 10 microns/hour. Any material can be used as a substrate which is resistant to deposition temperature and possesses high adhesion to carbon, Also other materials can be used as a substrate which are resistant to deposition temperatures and providing high adhesion to carbon. Prior deposition the substrate was treated with a diamond suspension using one of the standard techniques to increase concentration of the nucleation centers, In particular, an ultrasonic treatment Ran be used during 20–40 min.

Similar film texture was obtained using methane at concentration of 15–30% at the same parameters of deposition process.

The second method to produce a cold emission film cathode comprising a microwave discharge with input power of 5–50 W/cub.cm in a mixture of carbon dioxide and methane with the ratio of 0.8–1.2 at pressure of 20–100 Torr and deposition of the carbon phase on a substrate, further comprises that the deposition is carried out at the substrate temperature of 500–700 C.

If input power exceeds 50 W/cub.cm then the overheating of the gas and substrate surface takes place leading to worsening of the emissive performances of the film. If input power is less than 5 W/cub.cm then no sufficient activation of the working media is provided. Substrate temperature less than 500 C. or more than 700 C. results in a pronounced change of the film texture and loss of emissive properties.

The second method to produce a cold emission film cathode was carried out in a microwave discharge in a chamber with input power of 100–1000 W. For deposition a mixture of carbon dioxide and methane was used at pressure of 20–100 Torr. The carbon dioxide methane ratio was 0.8–1.2. Substrate surface temperature was 500–700 C. At such conditions a carbon film growth was provided up to 10 microns/hour. The substrate was prepared in the same way as for a method to produce a cold emission film cathode in a DC discharge.

APPLICABILITY IN INDUSTRY

Cold emission cathode fabricated using the suggested methods possesses high emissive performances, it is stable in high electrical fields, chemically resistant and therefore can be used to create flat panel displays, in electron microscopes, microwave electronics, light sources and some other applications. The methods to produce such cathode are of reasonable productivity. In addition to carbon, such structures can be also made from other conductive substances,

What is claimed is:

1. Cold emission film cathode comprising a substrate coated with a carbon film wherein said carbon film is made in the form of an irregular structure consisting of carbon micro and nano-ridges and/or micro or nano-threads normally oriented to the substrate surface and having typical size of 0.01–1 micron and density of 0.1–10 $\mu m^{-2}$.

2. Method to produce a cold emission film cathode comprising a DC discharge in a mixture of hydrogen and carbon containing gas, deposition of a carbon phase on a substrate placed on an anode, wherein said discharge has current density of 0.15–0.5 A/sq.cm and said deposition is carried out from a mixture of hydrogen and ethyl alcohol vapor or methane at a total pressure of 50–300 Torr and substrate temperature of 600–900 C., and concentration of ethyl alcohol shall be 5–10% and concentration of methane shall be 15–30%.

3. Method set forth in claim 2, wherein the deposition is made with adding into said gas mixture of up to 75% of an inert gas maintaining the total pressure unchanged.

4. Method to produce a cold emission film cathode comprising a microwave discharge with input power of 100–1000 W in a mixture of carbon dioxide and methane with the ratio of 0.8–1.2 at pressure of 20–100 Torr and deposition of the carbon phase on a substrate, and further comprising the deposition cared out at the substrate temperature of 500–700 C.

* * * * *

UNITED STATES PATENT AND TRADEMARK OFFICE

CERTIFICATE OF CORRECTION

PATENT NO. : 6,593,683 B1
DATED : July 15, 2003
INVENTOR(S) : Dzbanovsky et al.

It is certified that error appears in the above-identified patent and that said Letters Patent is hereby corrected as shown below:

Column 4,
Line 61, “cared” should read -- carried --

Signed and Sealed this

Sixteenth Day of December, 2003

JAMES E. ROGAN
*Director of the United States Patent and Trademark Office*